US010710859B2

(12) United States Patent
Zheng et al.

(10) Patent No.: US 10,710,859 B2
(45) Date of Patent: Jul. 14, 2020

(54) SLEEVE TYPE BOTTLE OPENER SUITABLE FOR BOTTLE STOPPERS OF DIFFERENT SIZES

(71) Applicant: Zhuhai Kelitong Electronic Co., Ltd., Zhuhai (CN)

(72) Inventors: Shao Zheng, Guangdong (CN); Haihong Zhu, Guangdong (CN)

( * ) Notice: Subject to any disclaimer, the term of this patent is extended or adjusted under 35 U.S.C. 154(b) by 142 days.

(21) Appl. No.: 16/034,333

(22) Filed: Jul. 12, 2018

(65) Prior Publication Data

US 2019/0389707 A1 Dec. 26, 2019

(30) Foreign Application Priority Data

Jun. 20, 2018 (CN) ..... 2018 1 0639009

(51) Int. Cl.
*B67B 7/06* (2006.01)

(52) U.S. Cl.
CPC ..... *B67B 7/06* (2013.01)

(58) Field of Classification Search
CPC .... B67B 7/06; B67B 7/14; B67B 7/15; B67B 7/18
USPC ..... D8/40
See application file for complete search history.

(56) References Cited

U.S. PATENT DOCUMENTS

D193,899 S * 10/1962 Harrison ..... D8/40
3,730,025 A * 5/1973 Monnerjahn ..... B67B 7/18 81/3.4
4,337,678 A * 7/1982 Mumford ..... B67B 7/18 81/3.4
4,414,865 A * 11/1983 Brooks ..... B67B 7/18 81/3.09
4,615,242 A * 10/1986 Milin ..... B67B 7/18 81/3.08
7,152,505 B2 * 12/2006 Chan ..... B67B 7/18 81/3.4
7,267,031 B1 * 9/2007 Burton ..... B67B 7/18 81/3.09
7,748,293 B2 * 7/2010 Elwell ..... B67B 7/18 7/151
2008/0072709 A1 * 3/2008 Dye ..... B67B 7/16 81/3.09
2010/0187196 A1 * 7/2010 Wasenda ..... B65D 55/00 215/386

* cited by examiner

*Primary Examiner* — David B. Thomas
(74) *Attorney, Agent, or Firm* — Prakash Nama; Global IP Services, PLLC

(57) ABSTRACT

The present invention relates to the field of sleeve type bottle openers, in particular to a sleeve type bottle opener suitable for bottle stoppers of different sizes. The sleeve type bottle opener comprises a cylindrical sleeve body and a bottle mouth guide part, wherein the bottle mouth guide part is arranged at a lower end of the sleeve body. According to the present invention, rigid claws fixed to rigid walls as well as elastic claws fixed to elastic walls are arranged on an inner wall of the sleeve type bottle opener; the diameter of an inscribed circle corresponding to the elastic claws can vary with the stretching of the elastic walls, so that the sleeve type bottle opener can be applied to bottle stoppers of different sizes.

7 Claims, 3 Drawing Sheets

SLEEVE TYPE BOTTLE OPENER SUITABLE FOR BOTTLE STOPPERS OF DIFFERENT SIZES

BACKGROUND OF THE INVENTION

The invention relates to the field of sleeve type bottle openers, in particular to a sleeve type bottle opener suitable for bottle stoppers of different sizes.

With continuous improvement of people's living standards, drinking wine has become a way of life for more and more consumers. A wine bottle opener is an auxiliary tool to pull a cork out of the mouth of a wine bottle mouth. A common bottle opener usually includes a main body convenient for an operator to hold and a screw hook connected to the main body. The main body is held and rotated by hand to drive the screw hook to rotate and screw in the bottle stopper, and then to drive the bottle stopper to separate from the bottle stopper, thus completing the bottle opening action. In addition, along with the continuous popularization and application of automation technology, the automatic bottle opener is gradually replacing the traditional manual bottle opener.

As for the bottle opener, in order to enable a lower end of the bottle opener body to stably clamp the bottle neck of the wine bottle, a sleeve type bottle opener is generally embedded into and clamped at the lower end of the bottle opener body. However, the existing sleeve type bottle opener can only be applied to bottle stoppers of one size due to the fixed diameter of its claws, as a result the application range of the bottle opener is limited.

BRIEF SUMMARY OF THE INVENTION

In order to solve the above problems, the present invention provides a sleeve type bottle opener for bottle stoppers of different sizes, wherein an inscribed circle corresponding to claws inside for fixing a bottle stopper can be adjusted in diameter, so that the application range of the bottle opener is enlarged.

In order to achieve the above objective, a technical solution adopted by the present invention is as follows: a sleeve type bottle opener suitable for bottle stoppers of different sizes is provided, wherein the sleeve type bottle opener includes a cylindrical sleeve body and a bottle mouth guide part; an inner wall of the sleeve body is a cylindrical through hole whose upper and lower ends can be completely penetrated through, and the bottle mouth guide part, having one end with a smaller diameter coaxially connected to the lower end of the inner wall of the sleeve body, is arranged at the lower end of the sleeve body and is of a truncated cone shape; the inner wall of the sleeve body with a "⊏"-shaped through hole arranged on its both sides includes rigid walls and elastic walls, the "⊏"-shaped through holes and the inner wall of the sleeve body form two elastic walls having one side thereof respectively connected to an integrated structure of two rigid walls; protruded elastic claws and rigid claws, which are configured to prevent the bottle stopper from rotating, are respectively arranged inside the sleeve body along an axial direction, the rigid claws are fixed at one end of the surface of the rigid wall close to the surface of the elastic wall, the elastic claws are fixed at one end of the surface of the elastic wall far away from the rigid wall, and the protruding length of the elastic claw is greater than that of the rigid claw.

Further, the elastic claws and rigid claws whose cross sections are both of an isosceles triangle structure are evenly arranged at intervals, and bottom edges of the isosceles triangular structures are connected to an integrated structure of the rigid walls and the elastic walls, respectively.

Further, lower ends of the elastic claws and the rigid claws form arc-shaped sliding guide planes along the direction of the bottle mouth guide part.

Further, upper ends of the elastic claws and the rigid claws are inclined planes tilting down along an inner center.

Further, a clamping portion connected to a lower end of a bottle opener body is arranged at the upper end of the sleeve body; a plurality of protruded clamping blocks, between which a plurality of necks are formed, are arranged on both sides of an outer wall of the sleeve body along the axial direction.

Further, the length of the rigid claw along the axial direction is greater than that of the elastic claw along the axial direction.

Further, the sleeve type bottle opener is made of plastic.

The beneficial effect of the present invention are as follows: The sleeve type bottle opener provided by the present invention is provided with the rigid claws fixed to the rigid walls and the elastic claws fixed to the elastic walls on its inner wall, wherein the diameter of the inscribed circle corresponding to the rigid claws is fixed, while the diameter of the inscribed circle corresponding to the elastic claws can vary with the stretching of the elastic walls, so that the size of the inscribed circle of the bottle opener can be adjusted accordingly depending on the size of the bottle stopper, and therefore the bottle opener is applicable to bottle stoppers of different sizes, thus enlarging the application range of the bottle opener.

BRIEF DESCRIPTION OF THE DRAWINGS

FIG. 6 is a cutaway view B-B of the side view in FIG. 3 of the present invention, in which:

1: sleeve body; 11: rigid wall; 111: rigid claw; 12: elastic wall; 121: elastic claw; 13: "∟"-shaped through hole; 2: bottle mouth guide part; 3: sliding guide plane; 4: clamping portion; 5: protruded clamping block; 6: clamping groove.

DETAILED DESCRIPTION OF THE INVENTION

Figure 1:
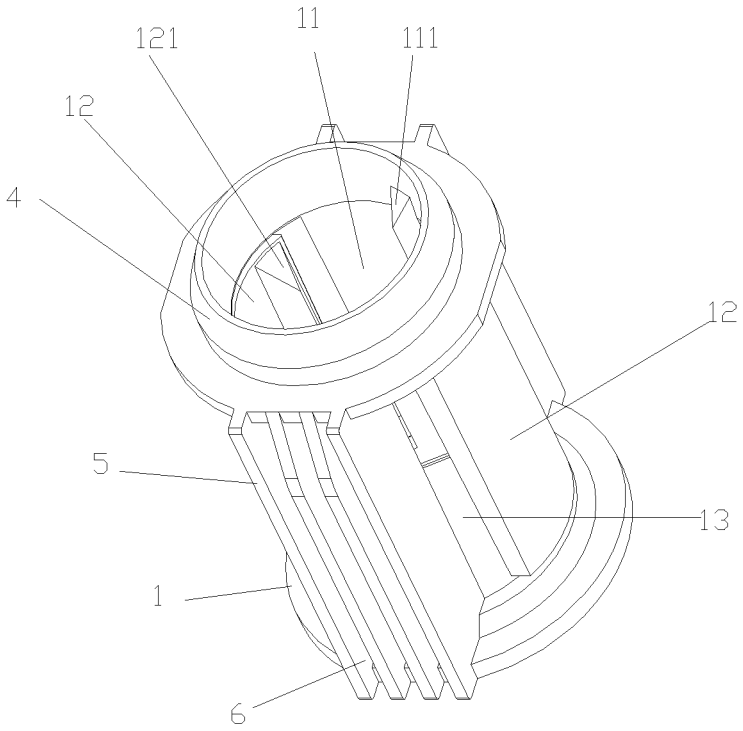
FIG. 1 is a solid structural diagram of the present invention.
Figure 2:
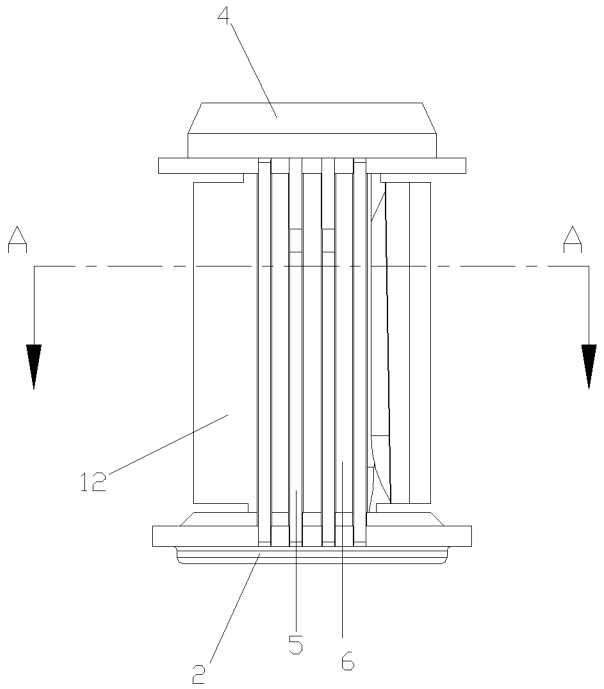
FIG. 2 is a front view of the present invention.
Figure 3:
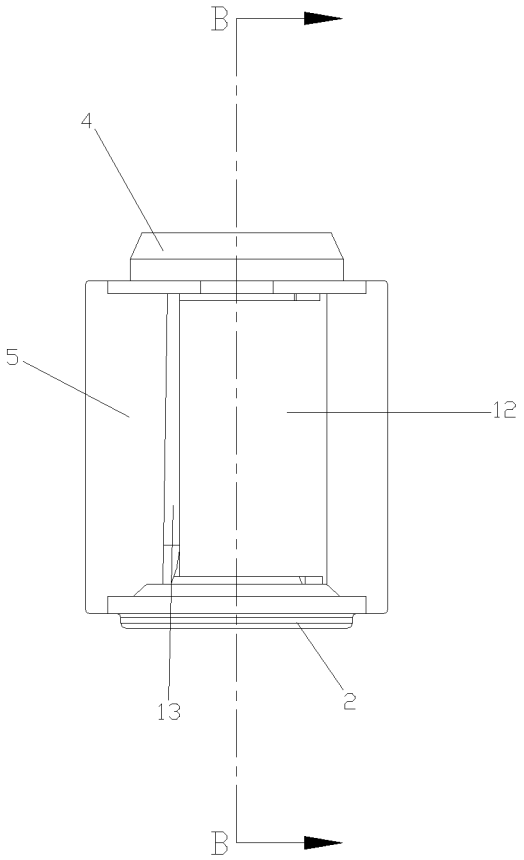
FIG. 3 is a side view of the present invention.
Figure 4:
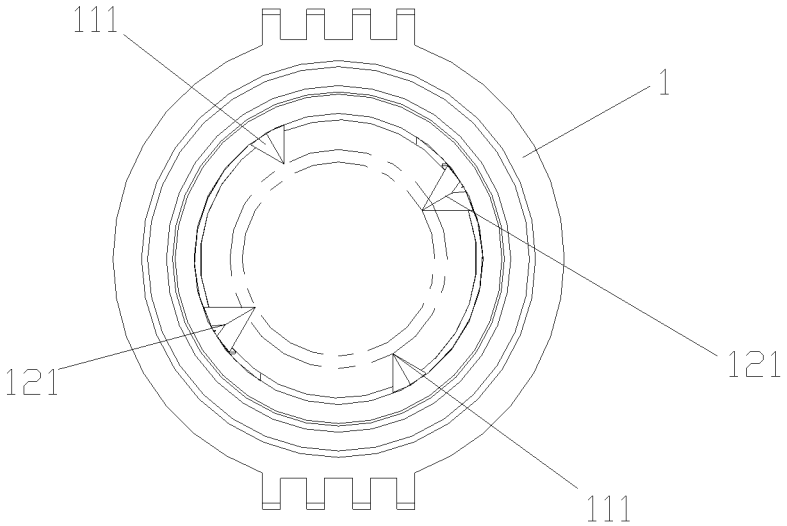
FIG. 4 is a top view of the present invention.
Figure 5:
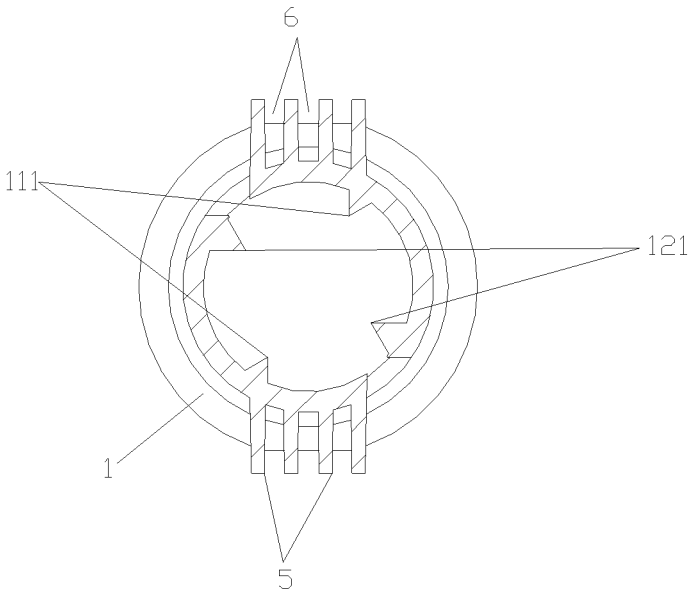
FIG. 5 is a cutaway view A-A of the front view in FIG. 2 of the present invention.
Figure 6:
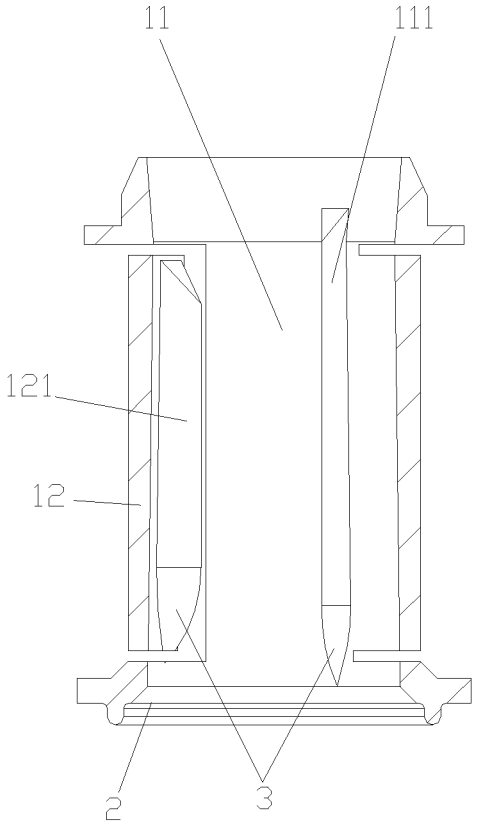

Please refer to FIGS. 1 to 6, the present invention relates to a sleeve type bottle opener suitable for bottle stoppers of different sizes, wherein the sleeve type bottle opener includes a cylindrical sleeve body 1 and a bottle mouth guide part 2. An inner wall of the sleeve body 1 is a cylindrical through hole whose upper and lower ends can be completely penetrated through. The bottle mouth guide part 2, having one end with a smaller diameter coaxially connected to the lower end of the inner wall of the sleeve body 1, is arranged at the lower end of the sleeve body 1 and is of a truncated cone shape. The inner wall of the sleeve body 1 with a "⊏"-shaped through hole 13 being arranged on its both sides includes rigid walls 11 and elastic walls 12, and the "∟"-shaped through holes 13 and the inner wall of the sleeve body 1 form two elastic walls 12 having one side thereof respectively connected to an integrated structure of two rigid walls 11. Protruded elastic claws 121 and rigid claws 111, which are configured to prevent the bottle stopper from rotating, are respectively arranged inside the sleeve body 1 along the axial direction. The rigid claws 111 are fixed at one end of the surface of the rigid wall 11 close to the surface of the elastic wall 12. The elastic claws 121 are fixed at one end of the surface of the elastic wall 12 far away from the rigid wall 11. The protruding length of the elastic claw 121 is greater than that of the rigid claw 111.

Compared with the prior art, the sleeve body 1 of the sleeve type bottle opener provided by the present invention is provided with the rigid claws 111 fixed to the rigid walls 11 and the elastic claws 121 fixed to the elastic walls 12 on its inner wall. the diameter of the inscribed circle corresponding to the rigid claws 111 is fixed, while the diameter of the inscribed circle corresponding to the elastic claws 121 can vary with the stretching of the elastic walls 12, so that the size of the inscribed circle of the bottle opener can be adjusted accordingly depending on the size of the bottle stopper, and therefore the bottle opener is applicable to bottle stoppers of different sizes, thus enlarging the application range of the bottle opener.

Further, the elastic claws 121 and rigid claws 111 whose cross sections are of an isosceles triangle structure are evenly arranged at intervals, and bottom edges of the isosceles triangular structures are respectively connected to an integrated structure of the rigid walls 11 and the elastic walls 12.

By adopting the above solution, the two rigid claws 111 arranged oppositely as a group can be used to fix the wine bottle stopper and prevent it from rotating, and the two elastic claws 121 arranged oppositely as a group are also used to fix the wine bottle stopper and prevent it from rotating; meanwhile, the inscribed circle corresponding to the elastic claws 121 can also vary in size due to external force.

In this embodiment, since the protruding length of the elastic claw 121 is greater than that of the rigid claw 111, the diameter of the inscribed circle corresponding to the elastic claws 121 will be smaller than that of the inscribed circle corresponding to the rigid claws 111 in a natural state. When the bottle stopper of the wine bottle is of a small size, the bottle stopper will be fixed by the elastic claws 121. When the bottle stopper of the wine bottle is of a relatively large size, the elastic claws 121 can exert an outward pressure on the elastic walls 12 due to the pressure exerted thereon by the bottle stopper, thus enabling the elastic walls 12 to stretch outward by a certain angle. In this way, the bottle stopper can enter the sleeve body 1 and be clamped and fixed by the elastic claws 121. Therefore, due to the structure of the elastic walls 12, the diameter of the inscribed circle corresponding to the elastic claws 121 can be adjusted, enlarging the application range of the bottle opener, so that the sleeve type bottle opener can be suitable for bottle stoppers of various sizes.

When the size of the bottle stopper is the same as that of the inscribed circle corresponding to the rigid claws 111, the elastic claws 121 are also stretched to the same diameter as that of the inscribed circle corresponding to the rigid claws 111. At this time, the elastic walls 12 are at a maximum stretching angle and the diameter of the inscribed circle corresponding to the elastic claws 121 is also at a maximum. Therefore, the stretching range of the elastic walls 12 is also limited, and there is no need to worry about damage of the elastic walls 12 due to excessive stretching.

Further, lower ends of the elastic claws 121 and the rigid claws 111 form arc-shaped sliding guide planes 3 along the direction of the bottle mouth guide part 2.

By adopting the above solution, the bottle mouth can be quickly guided and kept on the same axis with the lower end of the sleeve type bottle opener, so that the user can successfully complete the action of sheathing the sleeve body 1 on the bottle stopper.

Further, upper ends of the elastic claws 121 and the rigid claws 111 are inclined planes tilting down along an inner center.

By adopting the above solution, the sleeve body 1 is easily embedded into a lower end of the corresponding bottle opener body.

Further, a clamping portion 4 connected to the lower end of a bottle opener body is arranged at the upper end of the sleeve body 1. A plurality of protruded clamping blocks 5, between which a plurality of clamping grooves 6 are formed, are arranged on both sides of an outer wall of the sleeve body 1 along the axial direction.

By adopting the above solution, the sleeve body 1 is clamped with the lower end of the corresponding bottle opener body by means of the protruded clamping blocks 5 and the clamping grooves 6 to form a slide way capable of sliding up and down, so that the sleeve type bottle opener can move up and down along the lower end of the bottle opener body.

Further, the length of the rigid claw 111 along the axial direction is greater than that of the elastic claw 121 along the axial direction.

By adopting the above solution, a larger stopper first passes through the sliding guide plane 3 at the lower end of the rigid claw 111 and then passes through the sliding guide plane 3 of the elastic claw 121, so that the larger stopper can achieve more smooth transition to the elastic claw 121 from the rigid claw 111 without damaging the elastic claw 121 within the stretching range of the elastic wall 12.

Further, the sleeve type bottle opener is made of plastic.

With the above structure, the plastic sleeve type bottle opener with an integrated structure is lighter in weight, thereby making the entire bottle opener lighter.

The above embodiments merely describe the preferred embodiments of the present invention, and are not intended to limit the scope of the present invention. Without departing from the spirit of the present invention, various modifications and improvements made by a person of ordinary skill in the art to the technical solution of the present invention shall all fall within the protection scope defined by the claims of the present invention.

What is claimed is:

1. A sleeve type bottle opener suitable for bottle stoppers of different sizes, wherein the sleeve type bottle opener comprises a cylindrical sleeve body and a bottle mouth guide part; an inner wall of the sleeve body is a cylindrical through hole whose upper and lower ends can be completely penetrated through, and the bottle mouth guide part, having one end with a smaller diameter coaxially connected to the lower end of the inner wall of the sleeve body, is arranged at the lower end of the sleeve body and is of a truncated cone shape; the inner wall of the sleeve body with a "⊔"-shaped through hole being arranged on its both sides respectively comprises rigid walls and elastic walls, the "⊔"-shaped through holes and the inner wall of the sleeve body form two elastic walls having one side thereof respectively connected to an integrated structure of two rigid walls; protruded elastic claws and rigid claws, which are configured to prevent the bottle stopper from rotating, are respectively arranged inside the sleeve body along the axial direction, the rigid claws are fixed at one end of the surface of the rigid wall close to the surface of the elastic wall, the elastic claws are fixed at one end of the surface of the elastic wall far away from the rigid wall, and the protruding length of the elastic claw is greater than that of the rigid claw.

2. The sleeve type bottle opener suitable for bottle stoppers of different sizes according to claim 1, wherein the elastic claws and rigid claws whose cross sections are of an isosceles triangle structure are evenly arranged at intervals, and bottom edges of the isosceles triangular structures are respectively connected to an integrated structure of the rigid walls and the elastic walls.

3. The sleeve type bottle opener suitable for bottle stoppers of different sizes according to claim 1 or 2, wherein lower ends of the elastic claws and the rigid claws form arc-shaped sliding guide planes along the direction of the bottle mouth guide part.

4. The sleeve type bottle opener suitable for bottle stoppers of different sizes according to claim 1 or 2, wherein upper ends of the elastic claws and the rigid claws are inclined planes tilting down along an inner center.

5. The sleeve type bottle opener suitable for bottle stoppers of different sizes according to claim 1, wherein a clamping portion connected to a lower end of a bottle opener body is arranged at the upper end of the sleeve body; a plurality of protruded clamping blocks, between which a plurality of clamping grooves are formed, are arranged on both sides of an outer wall of the sleeve body along the axial direction.

6. The sleeve type bottle opener suitable for bottle stoppers of different sizes according to claim 1, wherein the length of the rigid claw along the axial direction is greater than that of the elastic claw along the axial direction.

7. The sleeve type bottle opener suitable for bottle stoppers of different sizes according to claim 1, wherein the sleeve type bottle opener is made of plastic.

* * * * *